US011147343B2

(12) United States Patent
Saint Louis

(10) Patent No.: US 11,147,343 B2
(45) Date of Patent: Oct. 19, 2021

(54) ARTICLE OF FOOTWEAR WITH REMOVABLE AND HEIGHT ADJUSTABLE HEEL

(71) Applicant: Anatalie Saint Louis, Rahway, NJ (US)

(72) Inventor: Anatalie Saint Louis, Rahway, NJ (US)

( * ) Notice: Subject to any disclaimer, the term of this patent is extended or adjusted under 35 U.S.C. 154(b) by 0 days.

(21) Appl. No.: 14/623,135

(22) Filed: Feb. 16, 2015

(65) Prior Publication Data

US 2015/0230555 A1 Aug. 20, 2015

Related U.S. Application Data

(60) Provisional application No. 61/941,147, filed on Feb. 18, 2014.

(51) Int. Cl.
*A43B 21/433* (2006.01)
*A43B 21/42* (2006.01)

(52) U.S. Cl.
CPC ..... *A43B 21/433* (2013.01); *A43B 21/42* (2013.01)

(58) Field of Classification Search
CPC ..... A43B 21/24; A43B 21/433; A43B 21/42; A43B 21/52
USPC ..... 36/39, 36 R, 36 A, 36 C, 42
See application file for complete search history.

(56) References Cited

U.S. PATENT DOCUMENTS 2,707,341 A 5/1955 Romano
2,767,489 A 10/1956 Sturman
2,888,755 A * 6/1959 Bartolucci ..... A43B 21/42 36/34 R
2,896,295 A * 7/1959 Fischer ..... F16B 2/065 248/507
2,934,840 A 5/1960 Mistarz
2,935,800 A * 5/1960 Ronci ..... A43B 21/42 36/42
3,056,217 A 10/1962 Tholander
3,074,187 A 1/1963 Klein
3,109,247 A 11/1963 Thiessen
3,141,249 A 7/1964 Perisse
3,514,879 A * 6/1970 Frattallone ..... A43B 21/46 36/42
3,805,418 A 4/1974 Matuka et al.
4,272,897 A * 6/1981 Ponce ..... A43B 23/22 36/24.5
4,363,177 A 12/1982 Boros
(Continued)

FOREIGN PATENT DOCUMENTS

WO 2006054157 5/2006

*Primary Examiner* — Shaun R Hurley
*Assistant Examiner* — Bao-Thieu L Nguyen
(74) *Attorney, Agent, or Firm* — Walter J. Tencza, Jr.

(57) ABSTRACT

There is an article of footwear that may have an interchangeable, height adjustable heel. The article of footwear has a recess in the heel portion. The height adjustable heel engages and is secured to the article of footwear by way of the cylindrical recess. The interior surface of this recess is preferably threaded, although it may have some other property that also enables securement of the height adjustable heel. The height adjustable heel has a connecting section and a base section. The connecting section engages the cylindrical recess. The base section can be of varying sizes allowing the article of footwear to take on a number of appearances and be worn in a variety of settings.

14 Claims, 3 Drawing Sheets

(56) References Cited

U.S. PATENT DOCUMENTS

| | | | | |
|---|---|---|---|---|
| 4,805,320 | A | 2/1989 | Goldenberg et al. | |
| 4,907,351 | A | 3/1990 | Hirai | |
| 5,347,730 | A | 9/1994 | Rodriguez Colon | |
| 5,581,910 | A * | 12/1996 | Lewis | A43B 1/0054 36/36 R |
| 5,953,836 | A | 9/1999 | Watt et al. | |
| 6,023,858 | A | 2/2000 | Srourian | |
| 6,785,987 | B2 | 9/2004 | Bucalo et al. | |
| 7,059,068 | B2 | 6/2006 | Magallanes et al. | |
| 7,877,902 | B2 | 2/2011 | Pieriboni | |
| 8,112,906 | B2 | 2/2012 | Paik | |
| 8,112,908 | B2 | 2/2012 | Visser | |
| 8,453,351 | B1 | 6/2013 | Hale | |
| 2008/0263898 | A1 * | 10/2008 | Gueh | A43B 3/24 36/100 |
| 2010/0137123 | A1 | 6/2010 | Alan et al. | |
| 2010/0139123 | A1 * | 6/2010 | Alan | A43B 3/24 36/100 |
| 2010/0187196 | A1 * | 7/2010 | Wasenda | B65D 55/00 215/386 |
| 2011/0061270 | A1 | 3/2011 | Vieira Teixeira Alves Gomes et al. | |
| 2011/0067265 | A1 * | 3/2011 | Green | A43B 13/30 36/42 |
| 2012/0085000 | A1 | 4/2012 | Alaimo | |
| 2012/0174435 | A1 | 7/2012 | Ruano Cerdan et al. | |
| 2013/0062231 | A1 * | 3/2013 | Angiulo | A43B 3/246 206/278 |
| 2014/0250736 | A1 * | 9/2014 | Zadeh | A43B 21/22 36/72 B |

* cited by examiner

ARTICLE OF FOOTWEAR WITH REMOVABLE AND HEIGHT ADJUSTABLE HEEL

CLAIM OF PRIORITY

This application claims the priority of U.S. Ser. No. 61/941,147 filed on Feb. 18, 2014, the contents of which are fully incorporated herein by reference in its entirety.

FIELD OF THE INVENTION

The field of the invention relates to modifications to articles of footwear, namely changing the height of the article of footwear. In particular to, a removable, height adjustable heel for use in an article of footwear thereby changing the height of the article of footwear quickly and easily.

BACKGROUND OF THE INVENTION

Articles of footwear, including sandals, shoes, boots, socks and the like, are worn daily by most in modern society. Historically, such footwear was typically worn for ornamental purposes and offered little to no protection to the wearer. Later, in the Middle Ages, it became more popular for people of wealth to use footwear and footwear having elevated heels as a status symbol. Such footwear was enjoyed by men and women alike. As modern technology continued to advance, the purpose behind footwear became more practical (protection, stability, etc.) than purely ornamental or to assert one's lofty status.

Advances in footwear has led to a number of design implementations such as heel cups (support), built-in arches, reinforced toes, air cushioned soles, and durable lightweight materials. However, there are still drawbacks to current footwear technology. Women often wear high heels, for fashion purposes, which many doctors believe can lead to poor posture and increased falling risks. Additionally, the outer portions (sole, covering, etc.) may wear out on pressure points such as the heel requiring the purchase of new shoes or seeking the services of a cobbler. Thus, there is a need for an article of footwear that is height adaptable for a particular situation, as well as a heel that can readily be replaced inexpensively and expeditiously. Additionally, it is desirable to have a heel that resists wear and damage from daily activities. The present invention meets and exceeds these objectives.

Review of Related Technology:

U.S. Pat. No. 7,059,068 pertains to a height adjustable flexible shoe including a shoe upper portion having an open upper end, a closed lower end, and a body portion therebetween. The open upper end is dimensioned for receiving a foot therein. The closed lower end has a toe portion and a back portion. The back portion has a first heel portion extending downwardly therefrom. The body portion is comprised of an adjustable elastomeric material. A second heel portion is adapted for removably coupling with the first heel portion of the shoe upper portion. A third heel portion is adapted for removably coupling with the second heel portion. The first, second, and third heel portions are of substantially equal heights to provide significant control over the inclination of the shoe.

U.S. Pat. No. 4,907,351 pertains to a heel device for shoes having a heel and a heel lift detachably attached to the heel. An insertion hole is formed longitudinally at the heel, and an inserting rod of the shape corresponding to that of the insertion hole is stood on the heel lift. The inserting rod is detachably inserted into the insertion hole of the heel to attach or detach the heel lift to or from the heel. The inserting rod is rigidly held by a clamping member formed of a material having expansible and contractible properties and strong frictional force.

U.S. Pat. No. 3,141,249 pertains to a heel structure with interchangeable heel lifts for changing/adding a new heel when an old heel becomes worn down.

U.S. Patent Application 2008/0184598 pertains to a shoe which has a sole with a toe portion, a heel portion and an arch portion located between them. A two part heel which has a low heel block attached to the heel portion of the sole and includes a slot formed therein. A high heel extension piece is attached to the low heel block through a support beam having a substantially rectangular cross-section. The support beam is capable of limited axial and pivotal movement within slot. The dimensions of the support beam and the slot prevent rotational movement of the high heel extension piece about its central axis. The high heel extension piece can be pivoted relative to the sole between a first position wherein it underlies and is in alignment with the low heel block and a second position wherein it lies substantially beneath the arch portion of said sole. The bottom of the low heel block has a low heel lift that extends downwardly and engages the ground when the high heel extension piece is stowed. This low heel lift is completely enclosed and hidden by a beveled edge at the top of the high heel extension piece when it is in its vertical position high heel. A detent in the form of a spring biased ball incorporated within a rotatable slotted pivot and a depression in the support beam maintain the high heel extension piece in the desired position.

Various devices are known in the art. However, their structure and means of operation are substantially different from the present disclosure. The other inventions also fail to solve all the problems taught by the present disclosure. The present disclosure provides for a quick and easy interchangeable heel that not only changes the height of the article of footwear, but also provides for added traction and wear resistance. At least one embodiment of this invention is presented in the drawings below and will be described in more detail herein.

SUMMARY OF THE INVENTION

An article of footwear having a removable, height adjustable heel is described and taught having a sole portion; a toe portion; a heel portion, wherein a heel within the heel portion has a cylindrical recess defining an opening extending partially therethrough and wherein the cylindrical recess extends substantially vertical; an upper portion, wherein the upper portion of the article of footwear defines a cavity; and a removable, height adjustable heel having a base section and a connecting section, wherein the base section has a top and a bottom defining a height, wherein the connecting section is an extension extending substantially vertical from the top of the base section.

The article of footwear generally has the parts or components that one typically finds in various articles of footwear such as a sole portion, a toe portion, a heel portion, and an upper portion. The upper portion provides for a cavity that enables one to place their foot into and subsequently wear the article of footwear. The heel portion provides a heel cup for the heel of the foot, as well as a heel extending from the heel portion. The heel has a cylindrical recess extending partially therethrough. The cylindrical recess should not encroach or traverse into the wearable portion of the article of footwear. The interior surface of the cylindrical recess is preferably threaded, but may also have a smooth nonslip surface that uses friction for securement purposes.

The removable, height adjustable heel is secured to the article of footwear using the cylindrical recess. The removable, height adjustable heel has a base section and a connecting section. The connecting section has threads or is made from a material selected to frictionably engage the interior of the cylindrical recess. The removable, height adjustable heel is designed to change the height of the article of footwear by about 0.6 cm (0.25 inch) to about 7.6 cm (3 inch) and more preferably about 1.3 cm (0.5 inch) to about 5 cm (2 inch). Further, the base section of the removable, height adjustable heel has a nonslip, wear-resistant layer to provide added traction and lengthen the life of the height adjustable heel. The nonslip, wear resistant layer may be textured metals, composites, resins, or the like or a combination thereof. Overall, the base section and the connecting section may be made of metal, plastic, ceramic, composite, glass, resin, or the like or any combination thereof.

In another aspect of the invention, there is a method of using a height adjustable heel for an article of footwear having the steps of providing an article of footwear, wherein the article of footwear has a sole portion, a heel portion, toe portion, and an upper portion, wherein the heel portion has a recess extending substantially vertical therein, wherein the upper portion of the article of footwear defines a cavity; selecting a removable, height adjustable heel having a base section and a connecting section; and engaging the recess with the removable, height adjustable heel. The method may further have the steps of removing the removable, height adjustable heel; selecting a separate removable, height adjustable heel; and engaging the recess with the separate removable, height adjustable heel. Even yet, the method may have the step of repeating the providing through engaging step for a second article of footwear.

In order to remove and/or replace a removable, height adjustable heel, one removes the article of footwear. The removable, height adjustable heel may be able to be removed by hand either by unscrewing or pulling on the base section of the removable, height adjustable heel. In some cases, it may be preferable to have a tool or adapter to provide added grip and torque to the base section. The adapter would have an interior surface that is substantially similar to that of the base section. By placing the adapter around the base section and subsequently pulling or turning, one can more easily remove the heel or increase its securement to the article of footwear. The process is designed to be expedient and efficient, allowing for multiple changes throughout the day and on the go.

In general, the present invention succeeds in conferring the following, and others not mentioned, benefits and objectives.

It is an object of the present invention to provide an article of footwear having a removable, height adjustable heel.

It is an object of the present invention to provide an article of footwear that has a heel that resists wear and provides traction.

It is an object of the present invention to provide an article of footwear that has a heel that can be changed quickly and easily.

It is an object of the present invention to provide an article of footwear that provides multiple height adjustable heels having differing heights.

It is an object of the present invention to provide an article of footwear that is versatile in nature and can be worn in a variety of settings.

It is an object of the present invention to provide a removable, height adjustable heel that can be used to replace a worn down heel on an article of footwear.

It is an object of the present invention to provide an adapter that aids an individual with changing the heel of a shoe thereby preventing dirt and grime from contacting the individual's hand.

It is still another object of the present invention to provide a method of changing the heel of an article of footwear.

It is still another object of the present invention to provide a an article of footwear with interchangeable pieces having different colors to match other pieces worn by an individual.

DETAILED DESCRIPTION OF THE DRAWINGS

Figure 1:
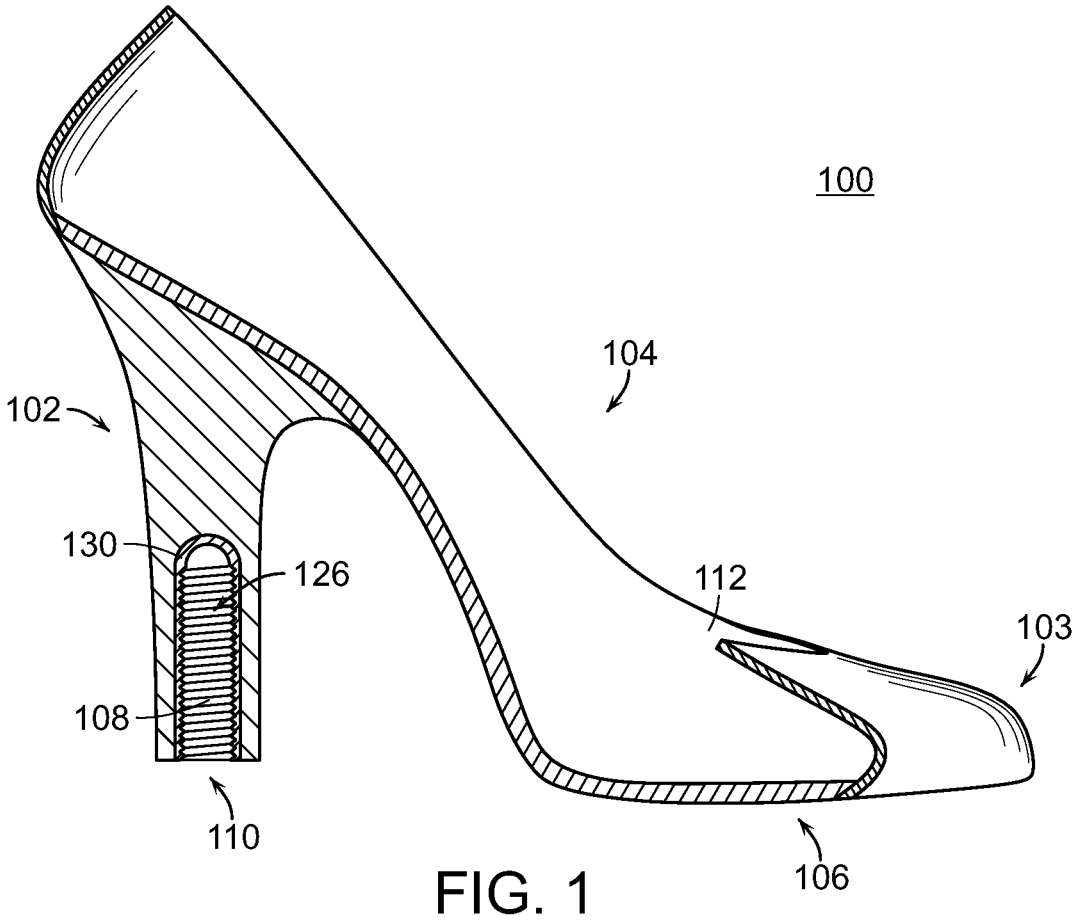
FIG. 1 is a perspective view of an article of footwear of the present invention.

The preferred embodiments of the present invention will now be described with reference to the drawings. Identical elements in the various figures are identified, as far as possible, with the same reference numerals.

Reference will now be made in detail to embodiments of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto without deviating from the innovative concepts of the invention.

Referring to FIG. 1, there is an article of footwear 100 consistent with the present invention. The article of footwear 100 has a sole portion 106, a toe portion 103, heel portion 102, and upper portion 104. The upper portion 104 defines a cavity 112 for the foot of a wearer. The sole portion 106 covers at least a portion of the bottom of the article of footwear 100.

The heel portion 102 includes a heel having a cylindrical recess 108 extending partially therethrough. The cylindrical recess 108 should not interfere or traverse into the portion of the article of footwear 100 that receives the foot. The cylindrical recess 108 defines an opening 110 at the bottom of the heel. Along the interior surface of the cylindrical recess 108 is threading 126 designed to engage a similarly threaded surface. Further, the cylindrical recess 108 may have a liner 130 that helps to stabilize and prevent movement of the cylindrical recess 108 and attached heel.

Figure 2A:
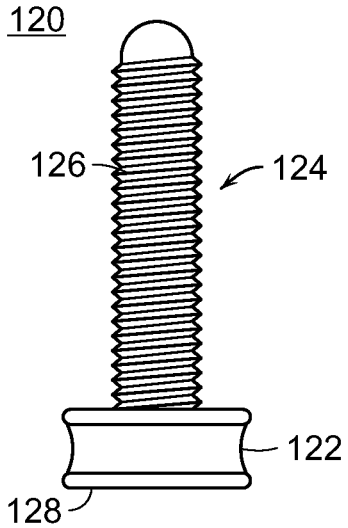
FIG. 2A is a side view of an interchangeable, height adjustable heel of the present invention.
Figure 2B:
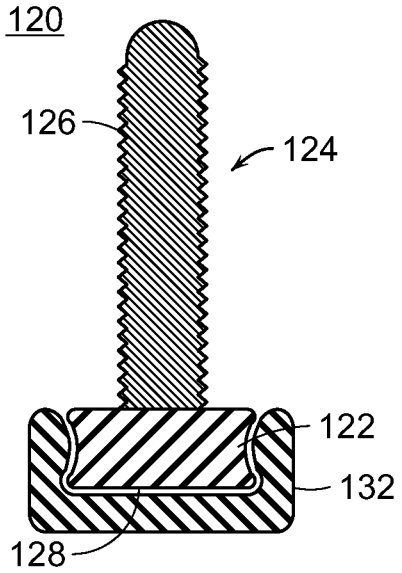
FIG. 2B is a side view of a second interchangeable, height adjustable heel having a greater thickness and showing an adapter for securing/removing the heel.

In FIGS. 2A and 2B, there is a removable, height adjustable heel 120. In each Figure the same general structure is shown. The removable height adjustable heel 120 comprises a base section 122 and a connecting section 124. The connecting section 124 may have threads 126 used to engage the cylindrical recess 108 (see FIG. 3) which extends substantially vertically through a portion of the heel portion 102.

On a bottom surface of the base section 122 there is a nonslip, wear-resistant layer 128. This layer 128 provides added traction and helps to prevent the heel 120 from wearing down and creating an uneven or unusable surface. In FIG. 2B, there is an adapter 132 shown. The adapter 132 is sized to have an interior surface that is substantially similar to the base section 122 of the removable heel 120. The adapter 132 provides added grip and torque thereby making the change between heels 120 effortless.

Preferably, the adapter 132 is made of a semi-rigid material that does not readily deform (i.e. resilient), but enables a user to provide increased grip by pressing the sides of the adapter 132 inwards towards the base section 122. The adapter 132 may have anti-microbial properties. The main function/purpose of the adapter 132 is to provide a simple and easy way to change the removable, height adjustable heel 120 while keeping the hands free of dirt and grime. The base sections 122 in FIG. 2A and FIG. 2B are of differing heights. The base section 122 can have a range of heights thereby changing the height of the heel.

Figure 3:
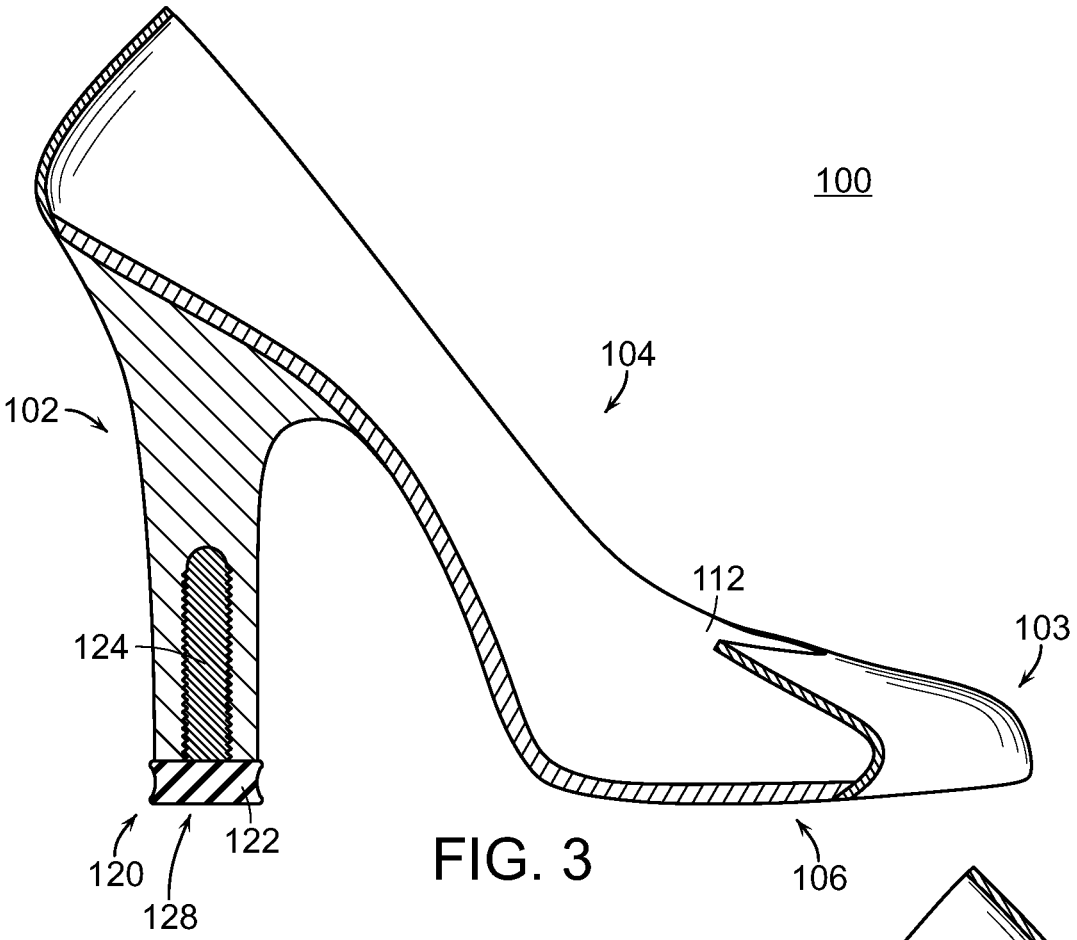
FIG. 3 is a perspective view of the article of footwear with an interchangeable, height adjustable heel used as intended.

In FIG. 3, the article of footwear 100 and the removable, height adjustable heel 120 have been brought together. Here, the connecting section 124 and the cylindrical recess 108 both have threading 126. The threading 126 allows the connecting section 124 and the cylindrical recess 108 to engage one another. This is achieved using a rotating motion and may be done with or without the aid of the adapter 132. Once the heel 120 is secured to the article of footwear 100 with the desired tightness, the article of footwear 100 is ready to be worn.

Figure 4:
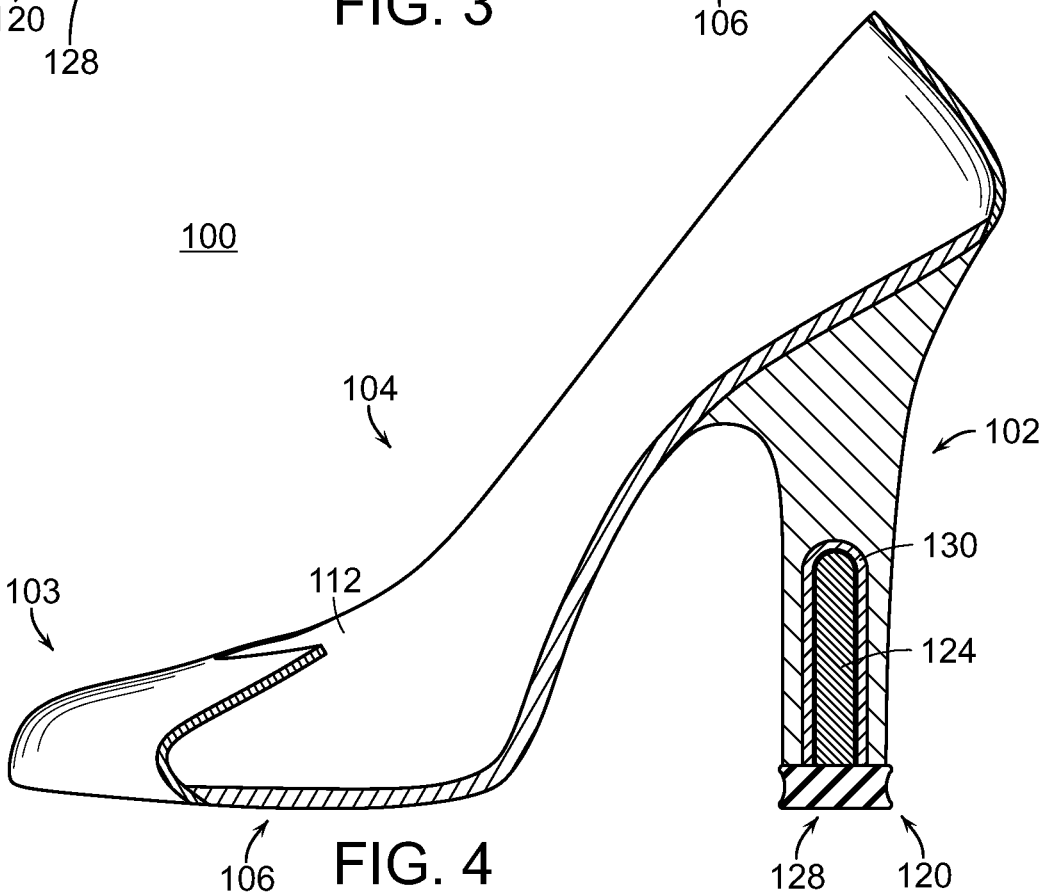
FIG. 4 is a perspective view of an alternate embodiment of the present invention.

FIG. 4 shows an alternate embodiment of the present invention wherein the article of footwear 100 and the removable, height adjustable heel 120 use friction as a securement mechanism rather than threading 126. Here, a number of materials and methodologies can be used to achieve a satisfactory securement of the two pieces. Such materials can vary but should have a coefficient of friction of at least 0.1 and preferably of at least 0.2.

Further, in addition to the coefficient of friction, the connecting section 124 and the cylindrical recess 108 may also have substantially the same size. That is, if the connecting section 124 has a diameter of about 1.2 cm (0.5 inch) then the cylindrical recess 108 has almost the same diameter. The slight variance in size permits a proper securement while preventing the two items from becoming stuck.

In this embodiment, the cylindrical recess 108 and connecting section 124 may be substantially smooth or may be textured depending on the size of each item, the materials chosen, and the desired fit or frictionable force to remove or add the removable, height adjustable heel 120. The article of footwear 100 may also have a liner 130 surrounding an outer surface of the cylindrical recess 108. This liner 130 can help combat shifts experienced by the wearer and increase resistance to wear.

Figure 5:
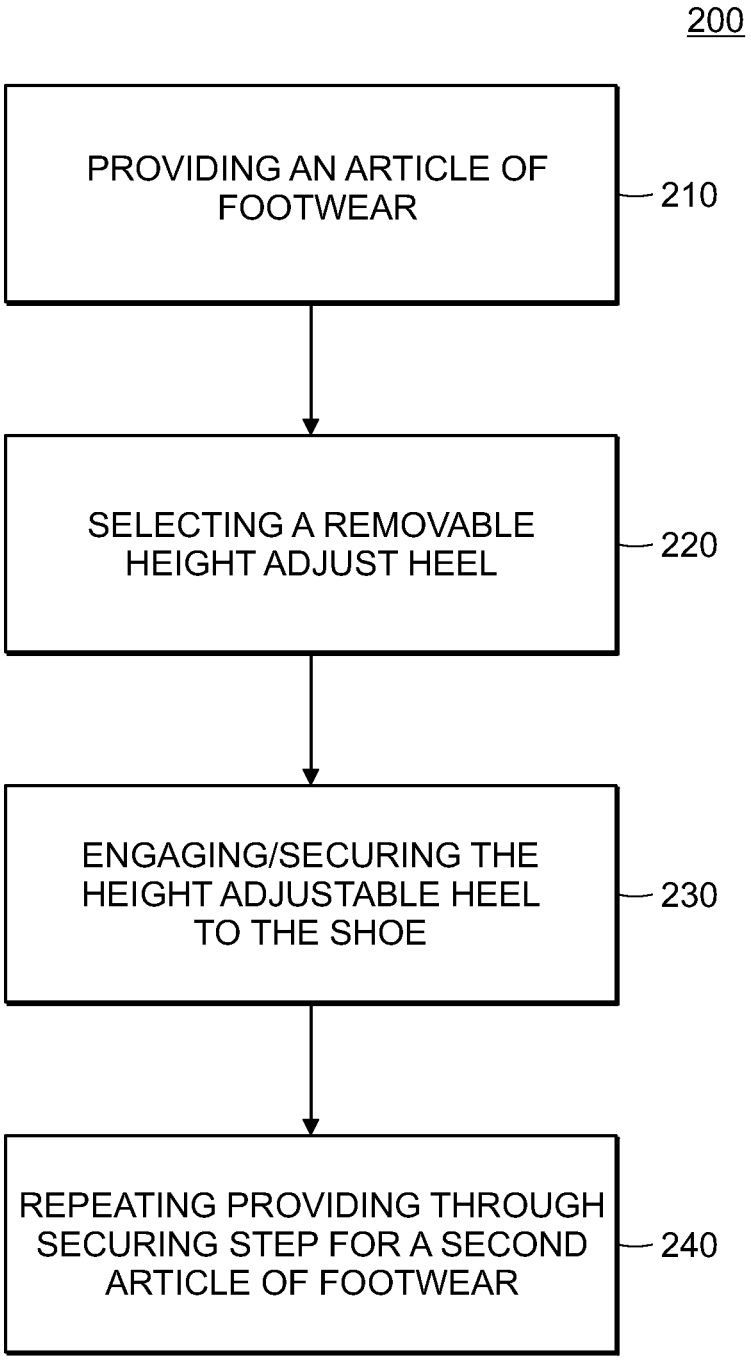
FIG. 5 is a flowchart describing a method of use of the present invention.

FIG. 5 is a flowchart describing a method 200 of using a removable, height adjustable heel for an article of footwear as described above.

In a box 210, one must provide an article of footwear. The article of footwear 100 is consistent with that previously described and may be modified from an existing state to have a cylindrical recess 108 extending partially through a heel portion 102 of the article of footwear 100.

In box 220, a removable, height adjustable heel 120 is selected. The heel could be selected for a number of reasons including color, shape, height, and the like.

An individual must then, as shown in box 230, engage and secure the removable, height adjustable heel 120 to the article of footwear 100. This can be achieved either with or without an adapter 132 or alternate securing mechanism.

The process may then repeat, in accordance with box 240, on a second article of footwear 100. The end result provides an individual with a matching pair of footwear that is ready for use. Alternatively, a user may only need to perform the method on one article of footwear 100 in the case of a broken or worn down heel 120. Additionally, an individual may wear one size, shape, or color heel 120 for part of the day and then remove that heel, select a separate heel, and engage/secure that new heel 120 to the article of footwear 100.

The article of footwear 100 shown in FIGS. 1-4 is generally shown as what would be classified as a women's high heeled shoe. However, the article of footwear 100 may be any type of shoe, sandal, boot, or the like and be appropriate for use by either gender. In some cases, it may be more desirable to simply use the present invention to replace a worn out or worn down heel rather than to change the height of the heel. In other cases, the heel may be changed to match the appearance of other items in the individual's wardrobe.

The article of footwear 100 is generally made of those materials known and used in the art to construct footwear. The present invention is also applicable to other not widely used or known materials or other materials that have yet to have been used for such a purpose or that have not been discovered.

The cylindrical recess 108 is preferably lined with a plastic with threads 126 in order to reduce weight and the associated costs. However, depending on the type of footwear and intended usage, it may be more practical to have a metal lined recess. Additionally, there may be a liner 130 surrounding the cylindrical recess 108. This liner 130 may help to prevent shifting and damage to occur to the article of footwear 100. Generally, the makeup of the cylindrical recess 108 and the connecting section 124 should comprise the same material to prevent undue wear and tear or breakage, however, in some embodiments differing materials may be preferred.

The base section 122 should comprise a plastic, wood, metal, composite, resin, or the like or any combination thereof. In some instances, the base section 122 and the connecting section 124 is a singular piece formed from the same material. This prevents the chance of breakage or a shearing of the base section 122 from the connecting section 124 which may cause serious injury. In other instances, where the pieces are individually combined pieces, the connecting section 124 should be embedded in the base section 122.

The wear resistant layer 128 should be resilient to wear and tear and provide an enhanced grip such as a textured or non-textured metal, composite, resin, or other suitable wear resistant material. It may be preferably to use a steel layer with a cross hatch pattern. However, other patterns such as ridges, grooves, or pointed protrusions may be used. The base section 122 may be any number of colors, shapes, sizes, or the like. For example, all or part of the base section 122 may be red and may be selected and secured to the heel 120 to match a red dress being worn.

Additionally the color may be used to match a color of another item present on the article of footwear such as laces on a shoe or ornamental piece disposed on a surface thereof. The top of the base section 122 should be of a shape that it creates a seamless appearance with the main body of the heel when properly secured. This visual appearance may be further enhanced by the selection of particular materials and/or colors that lend to blending between surfaces.

When selected for height altering purposes, the base section 122 may be readily available in a number of sizes ranging from about 0.6 cm (0.25 inch) to about 7.6 cm (3 inch) and more preferably about 1.3 cm (0.5 inch) to about 5 cm (2 inch). The size of the base section 122 should not change the height of the connecting section 126. There may be sets of removable, height adjustable heels 120 with base sections 122 varying by differing amounts such as increments of 0.6 cm (0.25 inch) or 1.3 cm (0.5 inch). Thus, an individual could own removable, height adjustable heels 120 with base sections 122 of about 1.3 cm (0.5 inch), about 1.9 cm (0.75 inch), about 2.54 cm (1 inch), about 3.2 cm (1.25 inch), etc. The change in height can be used for fashion or comfort purposes. For example, wearing footwear with a higher heel at a social gather and wearing a lower heel at work during the same day.

What is claimed is:

1. An apparatus comprising:
an article of footwear comprising:
a sole portion;
a toe portion;
a heel portion,
wherein the heel portion has a cylindrical recess defining an opening extending partially therethrough, and
wherein the cylindrical recess extends substantially vertically from a bottom of the heel portion to a location in an interior of the heel portion; and
an upper portion defining a cavity configured to receive a foot;
wherein the article of footwear is a high heeled shoe;
a first removable heel, separate from the article of footwear, having a base section and a connecting section, wherein the base section is fixed to the connecting section;
wherein the base section of the first removable heel has a top and a bottom defining a height,
wherein the connecting section of the first removable heel is an extension extending vertically from the top of the base section of the first removable heel,
wherein the cylindrical recess is configured to house the entirety of the connecting section of the first removable heel; and
a second removable heel, separate from the article of footwear, having a base section and a connecting section;
wherein the base section of the second removable heel has a top and a bottom defining a height;
wherein the connecting section of the second removable heel is an extension extending vertically from the top of the base section; and
wherein the cylindrical recess is configured to house the entirety of the connecting section of the second removable heel;
wherein the cylindrical recess is configured to house the entirety of only one at a time of either the connecting section of the first removable heel or the connecting section of the second removable heel to thereby connect only one at a time of either the first removable heel or the second removable heel to the heel portion;
wherein the connecting section of the first removable heel has a height;
wherein the connecting section of the second removable heel has a height;
wherein the height of the connecting section of the first removable heel is the same as the height of the connecting section of the second removable heel; and
wherein the base section of the first removable heel differs from the base section of the second removable heel.

2. The apparatus of claim 1 wherein the connecting section and the cylindrical recess are threaded enabling the threads on the connecting section to engage the threads on the cylindrical recess.

3. The apparatus of claim 1 wherein
the height of the base section of the first removable heel is different from the height of the base section of the second removable heel, such that when the entirety of the connecting section of the first removable heel is housed in the cylindrical recess of the heel portion, the height of the base section of the first removable heel supplements a height of the heel portion to provide a first height; and when the entirety of the connecting section of the second removable heel is housed in the cylindrical recess of the heel portion, the height of the base section of the second removable heel supplements the height of the heel portion to provide a second height, which is different from the first height.

4. The apparatus of claim 1 wherein
the base section of the first removable heel differs from the base section of the second removable heel in color.

5. The apparatus of claim 1 wherein the base section of the first removable heel differs from the base section of the second removable heel in shape.

6. The apparatus of claim 1 wherein the base section of the first removable heel differs from the base section of the second removable heel in size.

7. An adjustable footwear system comprising:
at least one article of footwear comprising:
a sole portion,
a toe portion,
a heel portion,
wherein the heel portion has a cylindrical recess defining an opening extending partially therethrough,
wherein the cylindrical recess extends substantially vertically from a bottom of the heel portion and ends within the heel portion between a top of the heel portion and the bottom of the heel portion, and
wherein the cylindrical recess is threaded; and
an upper portion defining a cavity configured to receive a foot;
wherein the at least one article of footwear is a high heeled shoe;
a first removable heel, separate from the at least one article of footwear, having a base section and a connecting section, wherein the connecting section of the first removable height heel is fixed to the base section of the first removable heel;
wherein the base section of the first removable heel has a top and a bottom defining a height,
wherein the connecting section of the first removable heel is threaded and extends substantially vertically from the top of the base section of the first removable heel, and wherein the cylindrical recess is configured to house the entirety of the connecting section of the first removable heel; and further comprising a second removable heel, separate from the at least one article of footwear, having a base section and a connecting section, wherein the connecting section of the second removable heel is fixed to the base section of the second removable heel;

wherein the base section of the second removable heel has a top and a bottom defining a height;

wherein the connecting section of the second removable heel has a height, wherein the connecting section of the first removable heel has a height, wherein the height of the connecting section of the second removable heel is the same as the height of the connecting section of the first removable heel, wherein the connecting section of the second removable heel is threaded and extends substantially vertically from the top of the base section of the second removable heel;

wherein the cylindrical recess is configured to house the entirety of the connecting section of the second removable heel; and wherein the heel portion remains secured as part of the at least one article of footwear when the cylindrical recess of the heel portion is open to receive either the connecting section of the first removable heel or the connecting section of the second removable heel;

and wherein the base section of the first removable heel is different from the base section of the second removable heel.

8. The adjustable footwear system of claim 7 wherein the height of the base section of the first removable heel is different from the height of the base section of the second removable heel.

9. The adjustable footwear system of claim 7 wherein the base section of the first removable heel differs from the base section of the second removable heel in color.

10. The adjustable footwear system of claim 7 wherein the base section of the first removable heel differs from the base section of the second removable heel in shape.

11. The adjustable footwear system of claim 7 further comprising a third removable heel, separate from the at least one article of footwear, having a base section and a connecting section, wherein the base section is fixed to the connecting section;

wherein the base section of the third removable heel has a top and a bottom defining a height, wherein the connecting section of the third removable heel is an extension extending vertically from the top of the base section of the third removable heel, wherein the cylindrical recess is configured to house the entirety of the connecting section of the third removable heel; and wherein the connecting section of the third removable heel has an overall structure, overall height, and overall width;

wherein the overall structures, overall heights, and overall widths, of the connecting sections of the first, second, and third removable heels are substantially the same; and wherein the heights of the base section of the first, the second, and the third removable heels differ from each other; and wherein the height of the base section of the second removable heel is approximately an increment less than the height of the base section of the third removable heel and approximately an increment more than the height of the base section of the first removable heel.

12. The apparatus of claim 1 further comprising a third removable heel, separate from the article of footwear, having a base section and a connecting section, wherein the base section is fixed to the connecting section;

wherein the base section of the third removable heel has a top and a bottom defining a height, wherein the connecting section of the third removable heel is an extension extending vertically from the top of the base section of the third removable heel, wherein the cylindrical recess is configured to house the entirety of the connecting section of the third removable heel; and wherein the connecting section of the third removable heel has a height;

wherein the heights of the connecting sections of the first, second, and third removable heels are the same; and wherein the base section of the third removable heel differs from the base section of the second removable heel, and from the base section of the first removable heel.

13. The apparatus of claim 12 wherein the heights of the base sections of the first, second, and third removable heels are different, such that when the entirety of the connecting section of the first removable heel is housed in the cylindrical recess of the heel portion, the height of the base section of the first removable heel supplements a height of the heel portion to provide a first height; when the entirety of the connecting section of the second removable heel is housed in the cylindrical recess of the heel portion, the height of the base section of the second removable heel supplements the height of the heel portion to provide a second height, and when the entirety of the connecting section of the third removable heel is housed in the cylindrical recess of the heel portion, the height of the base section of the third removable heel supplements the height of the heel portion to provide a third height; and wherein the first, second, and third heights are different from each other.

14. The apparatus of claim 12 wherein the height of the base section of the second removable heel is approximately an increment less than the height of the base section of the third removable heel and approximately an increment more than the height of the base section of the first removable heel.

* * * * *